US009062465B2

(12) United States Patent
Neubert et al.

(10) Patent No.: US 9,062,465 B2
(45) Date of Patent: Jun. 23, 2015

(54) DISTRIBUTING BOOM FOR CONCRETE PUMPS

(75) Inventors: Michael Neubert, Aichtal (DE); Matthias Braun, Aichtal (DE)

(73) Assignee: Putzmeister Engineering GmbH, Aichtal (DE)

( * ) Notice: Subject to any disclaimer, the term of this patent is extended or adjusted under 35 U.S.C. 154(b) by 0 days.

(21) Appl. No.: 14/124,304

(22) PCT Filed: Jun. 14, 2012

(86) PCT No.: PCT/EP2012/061245

§ 371 (c)(1), (2), (4) Date: Dec. 6, 2013

(87) PCT Pub. No.: WO2013/004460

PCT Pub. Date: Jan. 10, 2013

(65) Prior Publication Data

US 2014/0096853 A1 Apr. 10, 2014

(30) Foreign Application Priority Data

Jul. 7, 2011 (DE) ..... 10 2011 078 783

(51) Int. Cl.
*E04G 21/04* (2006.01)
*B66C 23/00* (2006.01)

(52) U.S. Cl.
CPC ..... *E04G 21/0445* (2013.01); *E04G 21/0418* (2013.01); *E04G 21/0436* (2013.01); *B66C 23/54* (2013.01); *E04G 21/0427* (2013.01)

(58) Field of Classification Search
CPC . E04G 21/04; E04G 21/0436; E04G 21/0463; E04G 21/0445; B67D 9/02
USPC ..... 137/615; 141/387
See application file for complete search history.

(56) References Cited

U.S. PATENT DOCUMENTS 3,707,990 A 1/1973 Schaible et al.
4,183,712 A 1/1980 Lindberg (Continued)

FOREIGN PATENT DOCUMENTS

DE 26 33 334 A1 2/1978
DE 42 03 820 A1 8/1993

(Continued)

OTHER PUBLICATIONS

International Search Report of PCT/EP2012/061245, mailed Sep. 24, 2012.
German Search Report in DE 10 2011 078 783.6, May 8, 2012.

*Primary Examiner* — Kevin Lee
(74) *Attorney, Agent, or Firm* — Collard & Roe, P.C.

(57) ABSTRACT

The invention relates to a distributing boom (14) for stationary or mobile concrete pumps. The distributing boom (14) consists substantially of a rotary head (22), which can be rotated about an axis of rotation (18) in the form of a vertical axis, and of an arm assembly (24), which is made up of a plurality of boom arms which can be telescoped or pivoted relative to one another. The arm assembly (24) has the one end of its first boom arm (1) articulated on the rotary head (22) and, by means of a first cylinder/piston unit (32), which has its ends articulated at points of articulation (28, 30) of the rotary head (22) and of the first boom arm (1), can be pivoted, about a horizontal axis of inflection (A), between a substantially horizontally oriented retracted position and an operating position. It is an aim of the invention to provide measures which make it possible for the cylinder/piston unit (32), which acts on the first boom arm (1), to be reduced in size. In order to achieve this, the invention proposes that the first boom arm (1) has acting on it at least one displacement-assisting element (36), which is effective over a defined pivoting range, starting from the retracted position of the boom arm.

9 Claims, 2 Drawing Sheets

(56) References Cited

U.S. PATENT DOCUMENTS

Figure 1:
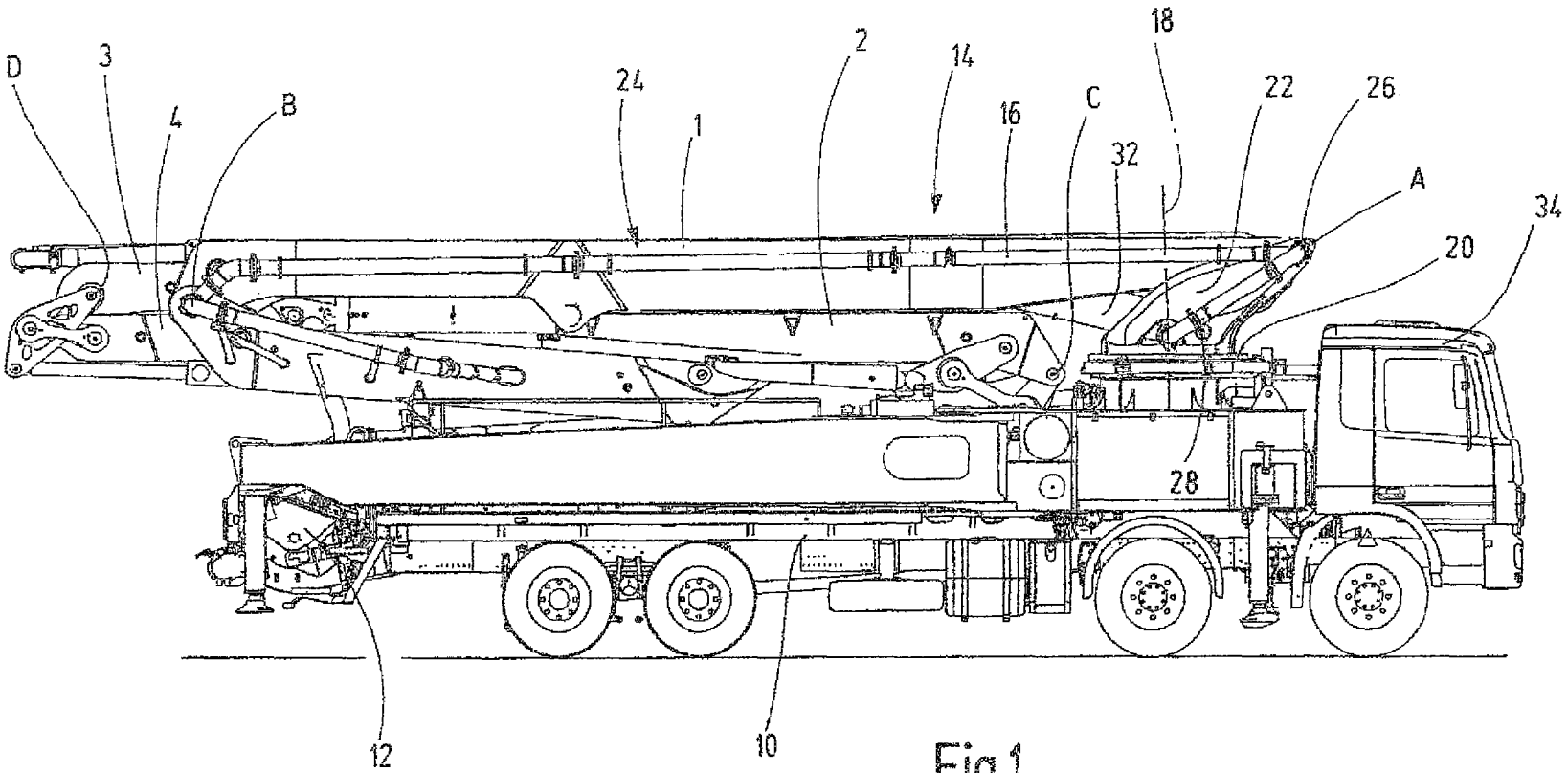

| | | | | |
|---|---|---|---|---|
| 5,775,475 | A | 7/1998 | Sardo | |
| 6,142,180 | A | 11/2000 | Woodling et al. | |
| 6,675,822 | B1 * | 1/2004 | Schmitz et al. | 141/387 |
| 6,786,233 | B1 * | 9/2004 | Anderson et al. | 137/615 |
| 7,909,059 | B2 * | 3/2011 | Wehner et al. | 137/615 |

FOREIGN PATENT DOCUMENTS

| | | | |
|---|---|---|---|
| DE | 10 2007 001 913 | A1 | 7/2008 |
| EP | 0 733 585 | A2 | 9/1996 |

* cited by examiner

DISTRIBUTING BOOM FOR CONCRETE PUMPS

CROSS REFERENCE TO RELATED APPLICATIONS

This application is the National Stage of PCT/EP2012/061245 filed on Jun. 14, 2012, which claims priority under 35 U.S.C. §119 of German Application No. 10 2011 078 783.6 filed on Jul. 7, 2011, the disclosure of which is incorporated by reference. The international application under PCT article 21(2) was not published in English.

BACKGROUND OF THE INVENTION

1. Field of the Invention

The invention relates to a distributing boom for stationary or mobile concrete pumps of the type mentioned herein.

2. Prior Art

Known distributing booms of this kind consist essentially of a rotary head rotatable about an axis of rotation in the form of a vertical axis, and of an arm assembly which is made up of a plurality of boom arms which can be telescoped or pivoted relative to one another. The arm assembly is attached articulated at one end of the first boom arm to the rotary head and, by means of a first cylinder/piston unit which has its ends articulated at points of articulation of the rotary head and of the first boom arm, can be pivoted about a horizontal axis of inflection between a substantially horizontally oriented retracted position and an operating position.

The distributing boom serves in a concrete pump as a support for a concrete supply line. Fluid concrete, which is introduced continuously into a material collecting container during concreting, is delivered via the concrete supply line to a concreting site which is arranged away from the stationary site of the vehicle. The arrangement of the boom arms of the arm assembly and the articulation points disposed between the same is matched with one another so that the distributing boom in its retracted position can be placed space-savingly on an associated substructure or chassis. By activating the drive assemblies between the boom arms the distributing boom can be brought into its operating position in which the boom tip can be guided by its end hose over the area which is to be concreted. Particular importance in respect of the retracting and extending process is placed on the deflection joint between the first boom arm and the rotary head and the cylinder/piston unit which is mounted there. If the arm assembly is located in the horizontally extended position then the greatest load moment is produced from the inherent weight of the arm, the operating load and the maximum distance of the center of gravity from the first axis of inflection. The relevant cylinder/piston unit must thus apply the highest force in this position to support the extended arm assembly. If the arm assembly is brought into the vertical position then with each increase in the setting angle the distance of the center of gravity of the arm assembly relative to the first axis of inflection is reduced. The same applies when the individual boom arms are moved towards the rotary head. This has the result that the cylinder force of the first cylinder/piston unit drops and from a certain distance of the center of gravity in relation to the cylinder engagement point a force level is reached from which a reduction of the cylinder diameter would basically be possible.

SUMMARY OF THE INVENTION

Starting from this premise the aim of the invention is to reduce the manufacturing costs by utilizing common parts and/or outsourced parts even with regard to the first cylinder/piston unit.

The combination of features disclosed herein is proposed to achieve this aim. Advantageous configurations and developments of the invention are also provided.

This is essentially achieved according to the invention in that the first boom arm has acting on it at least one displacement-assisting element, which is effective over a defined pivoting range, starting from the retracted position of the boom arm. The displacement-assisting element assists the first cylinder/piston unit particularly in the high-load region when the arm assembly is extended horizontally. Thus starting from the retracted position with the arm assembly elongated the cylinder force of the cylinder/piston unit engaging on the first boom arm and required for lifting, is reduced whereby a new way is opened up for utilizing common parts or for utilizing more cost-effective cylinder configurations.

The displacement-assisting element is expediently a compressive force element which by way of example can be designed as a hydrocylinder acting between a contact spot on the rotary head side and a contact point on a boom arm side. It is fundamentally also possible to use in place of the hydrocylinder compression springs which are arranged between contact points on the rotary head side and the boom arm side. The compression springs offer the advantage that no additional control element need be fitted in the existing hydraulic circuit and the arrangement can be constructed easily and more cost-effectively. Since the displacement assistance is only required in a certain angular range with high load moment the actuator forming the displacement-assisting element must be designed with a separation point. This can expediently be a contact spot which produces a force-locking connection. From a certain angle the first cylinder/piston unit supports the entire weight of the arm assembly by itself. The cylinder/piston unit must be designed for this. In the region of the force division the displacement-assisting element must be dimensioned so that it applies the required differential force for supporting the extended arm assembly. During the retracting process the at least one displacement-assisting element is moved along the defined pivotal path up to the retracted position into a pretensioned state.

More advantageously two displacement-assisting elements are provided.

A further preferred configuration of the invention proposes that the axis of inflection of the first boom arm is arranged eccentric relative to the axis of rotation of the rotary head on the side of the rotational axis which is opposite the tip of the first boom arm in its retracted position which is aligned substantially perpendicular to the axis of rotation. It has furthermore proved advantageous if the articulation of the cylinder/piston unit on the rotary head side is arranged eccentric relative to the rotational axis of the rotary head on the same side as the axis of inflection.

The distributing boom according to the invention is preferably used as a support for a concrete supply line in a stationary or mobile concrete pump wherein the rotary head is mounted on a substructure or a frame of the concrete pump rotatable about its axis of rotation and wherein the supply line which is guided via the distributing boom is connected to the pressure outlet of a pump assembly which is mounted fixed on a frame.

BRIEF DESCRITION OF THE DRAWINGS

Figure 2:
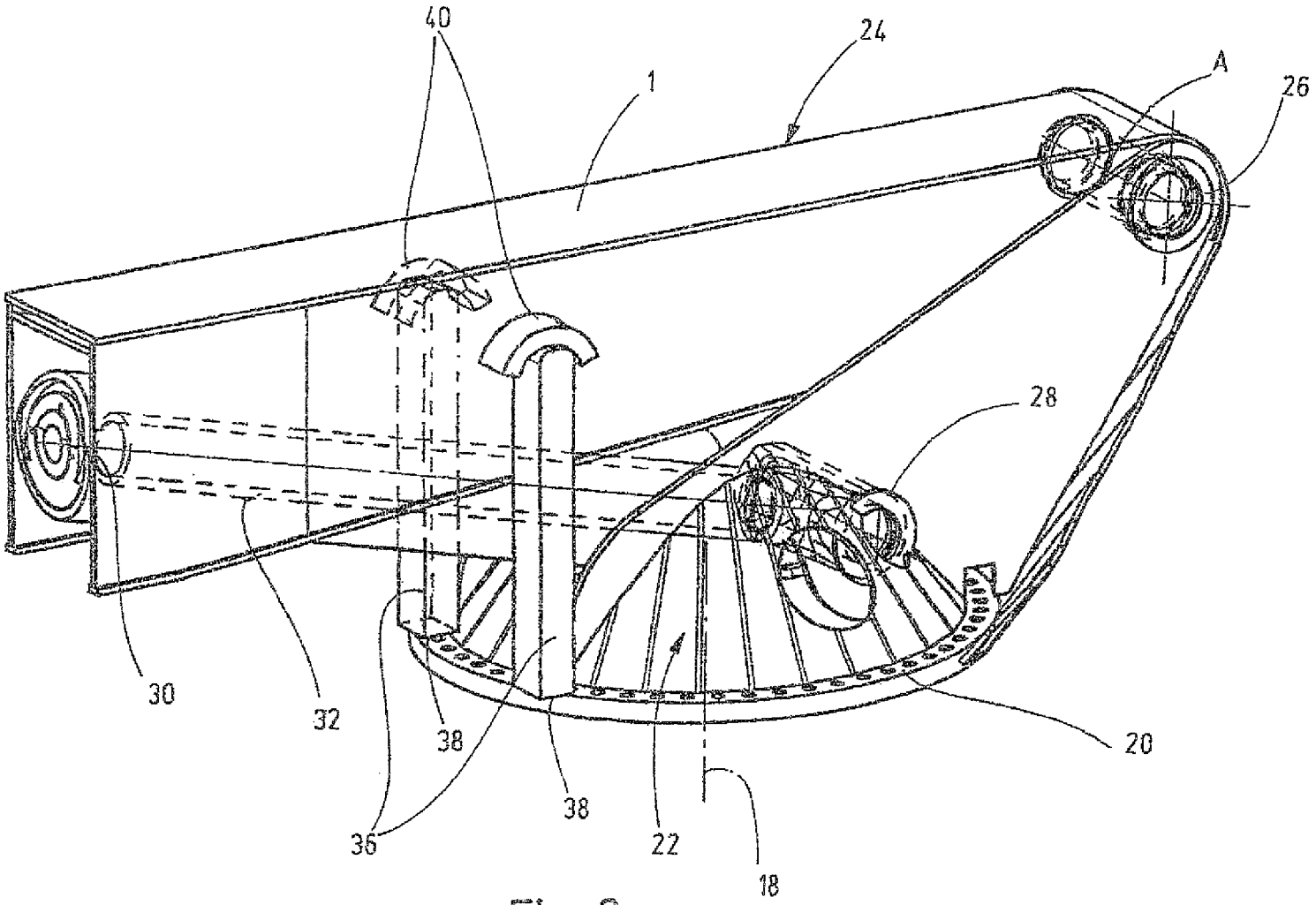

The invention will now be explained in further detail below with reference to an embodiment illustrated diagrammatically in the drawings. The drawings show FIG. 1 a side view of an auto concrete pump with a distributing boom designed as an inflection boom and shown in its retracted position;

FIG. 2 a sectional view of the first boom arm with rotary head, cylinder/piston unit and displacement-assisting elements.

DETAIL DESCRIPTION OF THE DRAWINGS

The auto concrete pump illustrated in FIG. 1 comprises a transport vehicle 10, a pump assembly 12 for fluid concrete and designed by way of example as a two-cylinder piston pump, as well as a distributing boom 14 as support for a supply line 16. Fluid concrete is supplied in the working position of the distributing boom 14 via the supply line 16 to a concreting site placed at a distance away from the stationary site of the vehicle 10.

The distributing boom 14 consists of a rotary head 22, having a rotary bearing 20 and rotatable about an axis of rotation 18 in the form of a vertical axis fixed on the vehicle, and of an arm assembly 24 which is composed of several boom arms 1, 2, 3, 4 which can be pivoted relative to one another, wherein the arm assembly is attached by an articulation point 26 to the end of its first boom arm 1 on the rotary head 22 and is pivotal by means of a cylinder/piston unit 32 attached by its ends to articulation points 28, 30 of the rotary head 22 and the first boom arm 1, about a horizontal axis of inflection A between a substantially horizontally aligned retracted position and a working position. The axes of inflection A, B, C, D and the boom arms 1, 2, 3, 4 of the arm assembly 24 are matched with each other dimensionally and kinematically so that the distributing boom 14 can be placed in the retracted position with a space-saving transport configuration on the transport vehicle 10. The cylinder/piston unit 32 is like the drive assemblies between the remaining boom arms designed as a hydrocylinder. Through a program-controlled activation of the drive assemblies which are assigned individually to the axes of inflection A, B, C, D, the distributing boom can be unfolded at different distances and/or vertical differences between the concreting site and the stationary site of the vehicle. The pump driver controls for example by means of a radio remote control the boom movement through which the boom tip is guided with its end hose over the area which is to be concreted.

As can be seen from FIGS. 1 and 2 the axis of inflection A of the first boom arm 1 is arranged eccentrically relative to the axis of rotation 18 of the rotary head 22 so that in the retracted position it is arranged on the side of the axis of rotation 18 facing the driver cab 34. The axis of inflection A is located in the illustrated embodiment radially outside of the rotary bearing 20 defining the rotary head 22. With this measure and with the given length of the distributing boom a reduction of the load moment is obtained in the region of the rotary head 22.

A special feature of the invention lies in the fact that two displacement-assisting elements 36 acting from the retracted position over a defined pivotal range engage on the first boom arm 1. The displacement-assisting elements 36 assist the cylinder/piston unit 32 particularly in the high load region when the arm assembly 24 is horizontally extended. Thus starting from the retracted position with an elongated arm assembly 24 the cylinder force of the cylinder/piston unit 32 engaging on the first boom arm 1 and required for lifting is thus reduced.

With the embodiment illustrated in FIG. 2 the displacement-assisting elements 36 are by way of example designed as hydrocylinders acting between an articulation point 38 on the rotary head side and a contact point 40 on the boom arm side. During the extending process the first boom arm 1 after exceeding the defined pivotal path is raised with its contact points 40 by the displacement-assisting elements 36 so that from this angular position only the cylinder/piston unit 32 supports the engaging residual load of the arm assembly 24. The displacement-assisting elements 36 thus ensure that the cylinder/piston unit 32 can be made with smaller dimensions so that a new way is opened up for utilizing common parts or for utilizing more cost-effective cylinder configurations.

Further structural designs are based on using compression springs in place of the hydrocylinders as displacement-assisting elements 36. These can be made as a whole lighter and more cost-effectively. An additional control module in the hydraulic circuit can furthermore be omitted.

To summarize: the invention relates to a distributing boom 14 for stationary or mobile concrete pumps. The distributing boom 14 consists essentially of a rotary head 22 which can be rotated about an axis of rotation 18 in the form of a vertical axis, and of an arm assembly 24 which is made up of a plurality of boom arms which can be telescoped or pivoted relative to one another. The arm assembly 24 has the one end of its first boom arm 1 articulated on the rotary head 22 and, by means of a first cylinder/piston unit 32, which has its ends articulated at points of articulation 28, 30 of the rotary head 22 and of the first boom arm 1, can be pivoted about a horizontal axis of inflection A between a substantially horizontally oriented retracted position and an operating position. The aim of the invention is to provide measures which make it possible for the cylinder/piston unit 32 which acts on the first boom arm 1 to be reduced in size. In order to achieve this it is proposed according to the invention that the first boom arm 1 has acting on it at least one displacement-assisting element 36 which is effective over a defined pivoting range, starting from the retracted position of the boom arm.

LIST OF REFERENCE NUMERALS

A, B,C, D Horizontal inflection axis
1,2,3,4 Boom arms
10 Transport vehicle
12 Pump assembly
14 Distributing boom
16 Supply line
18 Axis of rotation
20 Rotary bearing
22 Rotary head
24 Arm assembly
26,28,30 Articulation point
32 Cylinder/piston unit
34 Driver cab
36 Displacement-assisting elements
38 Articulation point on rotary head side
40 Contact point on boom arm side

The invention claimed is:

1. A distributing boom for stationary or mobile concrete pumps comprising:

a rotary head which is rotated about an axis of rotation comprising a vertical axis, an arm assembly which is made up of a plurality of boom arms which are telescoped or pivoted relative to one another, wherein the plurality of boom arms comprises a first boom arm and the arm assembly has one end of the first boom arm articulated on the rotary head, a first cylinder/piston unit having ends articulated at points of articulation of the rotary head and of the first boom arm, wherein the first cylinder/piston unit pivots the arm assembly about a horizontal axis of inflection between a substantially horizontally oriented retracted position and an operating position, and at least one displacement-assisting element acting on the first boom arm, wherein the at least one displacement-assisting element is effective over a defined pivoting range, starting from a retracted position of the first boom arm, and is articulated either on the rotary head and bears freely against a contact point on the first boom arm or is articulated on the first boom arm and bears freely against a contact point on the rotary head.

2. The distributing boom as claimed in claim 1, wherein the displacement-assisting element comprises a spring element pretensioned between a contact point on a rotary head side and a contact point on a boom arm side.

3. The distributing boom as claimed in claim 1, wherein the displacement-assisting element comprises a hydrocylinder acting between a contact point on a rotary head side and a contact point on a boom arm side.

4. The distributing boom as claimed in claim 1, wherein after exceeding a defined pivotal path, the first boom arm is lifted by the at least one displacement-assisting element.

5. The distributing boom as claimed in claim 1, wherein the first boom arm sets the at least one displacement-assisting element into a pretensioned state during a retracting process along a defined pivotal path up to the retracted position.

6. The distributing boom as claimed in claim 1, wherein two displacement-assisting elements are provided.

7. The distributing boom as claimed in claim 1, wherein an axis of inflection of the first boom arm is arranged eccentric relative to the axis of rotation of the rotary head on a side of the rotary axis opposite a tip of the first boom arm in the retracted position aligned substantially perpendicular to the axis of rotation.

8. The distributing boom as claimed in claim 7, wherein an articulation point of the first cylinder/piston unit is arranged eccentric relative to the axis of rotation of the rotary head on a same side as the axis of inflection.

9. A method for supporting a concrete supply line in a stationary or mobile concrete pump, the method comprising the steps of:

a) providing a distributing boom for a stationary or mobile concrete pump, the distributing boom comprising:

a rotary head which is rotated about an axis of rotation comprising a vertical axis;

an arm assembly which is made up of a plurality of boom arms which are telescoped or pivoted relative to one another, wherein the plurality of boom arms comprises a first boom arm and the arm assembly has one end of the first boom arm articulated on the rotary head;

a first cylinder/piston unit having ends articulated at points of articulation of the rotary head and of the first boom arm, wherein the first cylinder/piston unit pivots the arm assembly about a horizontal axis of inflection between a substantially horizontally oriented retracted position and an operating position; and at least one displacement-assisting element acting on the first boom arm, wherein the at least one displacement-assisting element is effective over a defined pivoting range, starting from a retracted position of the first boom arm, and is articulated either on the rotary head and bears freely against a contact point on the first boom arm or is articulated on the first boom arm and bears freely against a contact point on the rotary head;

b) arranging the rotary head on a substructure or a frame of the stationary or mobile concrete pump;

c) attaching a supply line to a pressure outlet of a pump assembly fixedly mounted on the frame; and d) guiding the supply line over the distributing boom.

* * * * *